US006250732B1

(12) United States Patent
Coven

(10) Patent No.: US 6,250,732 B1
(45) Date of Patent: Jun. 26, 2001

(54) POWER DROOP COMPENSATION FOR AN INKJET PRINTHEAD

(75) Inventor: Patrick J. Coven, Albany, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/343,290

(22) Filed: Jun. 30, 1999

(51) Int. Cl.[7] ..... B41J 29/38
(52) U.S. Cl. ..... 347/12; 347/9
(58) Field of Search ..... 347/10, 11, 12

(56) References Cited

U.S. PATENT DOCUMENTS

| | | | | |
|---|---|---|---|---|
| 4,215,350 | | 7/1980 | Mielke et al. . | |
| 4,989,016 | * | 1/1991 | Gatten et al. . | |
| 5,109,233 | * | 4/1992 | Nishikawa . | |
| 5,357,081 | | 10/1994 | Bohoroquez | 219/497 |
| 5,442,383 | * | 8/1995 | Fuse | 347/19 |
| 5,477,243 | | 12/1995 | Tamura | 347/12 |
| 5,508,724 | | 4/1996 | Boyd et al. | 347/58 |
| 5,594,478 | | 1/1997 | Matsubara et al. | 347/41 |
| 5,610,635 | * | 3/1997 | Murray et al. | 347/7 |
| 5,635,968 | * | 6/1997 | Bhaskar et al. | 347/59 |
| 5,644,342 | | 7/1997 | Argyres | 347/12 |
| 5,677,577 | | 10/1997 | Barbehenn et al. | 307/98 |

* cited by examiner

*Primary Examiner*—John Barlow
*Assistant Examiner*—Alfred Dudding

(57) ABSTRACT

A method and apparatus for reducing power droop for an inkjet printing system comprising a computer, an inkjet printer and a print cartridge. The print cartridge contains a printhead wherein the print head comprises a power supply circuit and a plurality of heater resistors that are arranged in primitive groups. The primitive groups of heater resistors are further arranged into a first and second column. The power supply circuit generates pulses that sequentially energizes one half of the heater resistor group (odd column then even column) within the same time period previously required to fire all of the heater resistors simultaneously. Thus, by employing this configuration and firing technique of the heater resistors, power droop is minimized because a reduced number of primitives are fired at any one time.

5 Claims, 9 Drawing Sheets

POWER DROOP COMPENSATION FOR AN INKJET PRINTHEAD

FIELD OF THE INVENTION

This invention relates to printers and more specifically, to a method and apparatus for reducing power swings (droop) during printing.

BACKGROUND OF THE INVENTION

Thermal inkjet printers have experienced a great deal of commercial success since their inception in the early 1980's. The fundamental principles of how thermal inkjet printers work is analogous to what happens when a pot of coffee is made. Using the electric drip coffee maker analogy, water is poured into a container (reservoir) that has a heating element at its base. Once the coffee has been placed in the filter, the coffee maker is turned on and power is supplied to a heating element that is now surrounded by water. As the heating element reaches a certain temperature, some of the water surrounding it changes from a liquid to a gas, thus, creating bubbles within the water. As these "super heated" bubbles are formed, heated water surrounding these bubbles is pushed from the reservoir into a tube and finally into the carafe. Referring now to the thermal printhead, ink is located in a reservoir that has a heating element (heater resistor) at its base. When the heater resistor is turned on for a certain amount of time (pulsed by electronic circuitry) corresponding to a certain temperature, the ink surrounding the heater resistor changes from a liquid to gas phase, thus, creating a bubble that pushes surrounding ink through an orifice and finally onto a printing medium. The aforementioned example radically simplifies inkjet technology. For a more detailed treatment of the history and fundamental principles of thermal inkjet technology, refer to the *Hewlett-Packard Journal,* Vol. 36, No. 5, May 1985.

In the coffee maker analogy, only one heating element is turned on to heat the water, whereas, in a thermal inkjet printhead, up to and exceeding 200 heating elements (heater resistors) may be turned on (fired) simultaneously. The simultaneously fired heater resistors can create great demands on the power supply circuitry. Although there are power supply circuits that may supply a constant power under dynamic loading conditions, the application of these systems in inkjet technology is often not practical. Cost, size and the small dimensions of the wires used to distribute power to the heater resistors often confine the application of such power supply systems. Therefore, it is not uncommon in inkjet technology to employ power supply circuits and conductors that are limited in their ability to robustly supply constant power to all heater resistors on the printhead simultaneously. Consequently, in print modes that require all heater resistors to be on, the power may droop (at the heater resistor) to a level insufficient to consistently create liquid to gas phase transformations of the ink. When this occurs, several undesirable characteristics of the printhead are created including but not limited to: (1) The heater resistors may not turn on at the same time, causing inconsistencies in the placement of ink on the writing medium; (2) the heater resistors may partially turn on, creating droplets of varying size and direction; and (3) the time required for the power supply circuitry to respond in preparation for the next firing instruction increases.

SUMMARY OF THE INVENTION

A preferred embodiment of the invention minimizes power droop experienced by a power supply circuit that delivers power to heater resistors on an inkjet printhead. In one such embodiment, a computer and an inkjet printer including a print cartridge capable of being moved transversely to a printing medium is described. The print cartridge further includes a power supply circuit and a printhead. The printhead is comprised of at least two primitive groups of heater resistors. A first portion of the primitive groups of heater resistors is arranged in a first column and a remaining portion of the primitive group of heater resistors is arranged in a second column that is substantially parallel to the first column. The sum of the time required to energize all of the heater resistor in the first and second column equals a cycle time. The power supply circuit generates energizing pulses at a rate corresponding to a fraction of the reciprocal of the cycle time such that a portion of the heater resistors are fired (a first column then a second column) within a time period previously required to fire all of the heater resistors simultaneously. Thus, by employing this configuration and firing technique of the heater resistors, power droop is minimized because a reduced number of primitives are fired at any one time.

BRIEF DESCRIPTION OF THE DRAWINGS

The present invention can be further understood by reference to the following description and attached drawings that illustrate a preferred embodiment. Other features and advantages will be apparent from the following detailed description of a preferred embodiment, taken in conjunction with the accompanying drawings, which illustrate, by way of example, the principles of the invention.

DETAILED DESCRIPTION OF A PREFERRED EMBODIMENT

The current invention addresses the problem of power droop by defining groups of heater resistors arranged in two parallel columns. Each column of heater resistors is coupled to an electronic power supply circuit. The power supply circuit generates pulses that sequentially fire one half of the heater resistor group (odd column then even column) within the same time period previously required to fire all of the heater resistors simultaneously. By employing this configuration and firing technique of the heater resistors, power droop is minimized.

Figure 1:
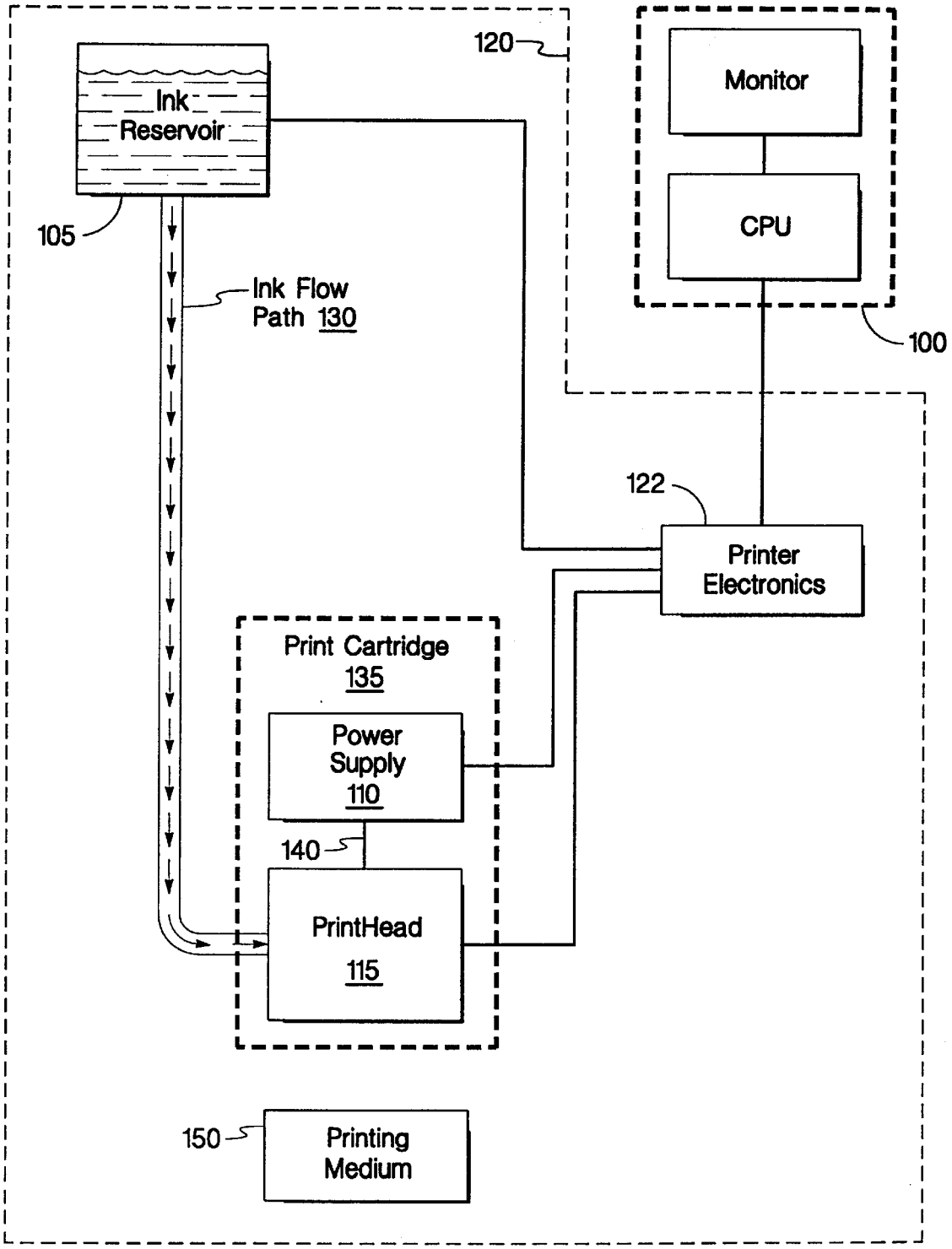
FIG. 1 is a computer controlled inkjet printing system showing a preferred embodiment which may use the present invention.

The block diagram of FIG. 1 shows a computer 100 coupled to an inkjet printer 120. Although a computer is illustrated in the shown embodiment, an input device or microcontroller connected to the inkjet printer will provide equivalent results. The inkjet printer includes a print cartridge 135 which is moves across the printing medium 150 at a continuous scan speed while receiving printing instructions from the inkjet printer process controller 122. In a preferred embodiment, the print cartridge receives ink from the ink reservoir 105 via an ink flow path 130. Additionally, the body of the print cartridge 135 is a fractionally hollow plastic housing which contains one or more ink printing containment components. These components are fluidically coupled to a device that rapidly heats small quantities of the ink. This device heats the ink beyond boiling and ejects the small quantities of ink (an ink droplet), displaced by an ink vapor bubble, through a small orifice for deposition on a printing medium 150. This ink routing and boiling device is commonly referred to as a printhead and is depicted as printhead 115 in FIG. 1. For additional information on the general construction and operation of thermal inkjet systems refer to the Hewlett-Packard Journal, Vol. 39, No. 4, August 1988 and the Hewlett-Packard Journal, Vol. 45, No. 1, February 1994.

Figure 2:
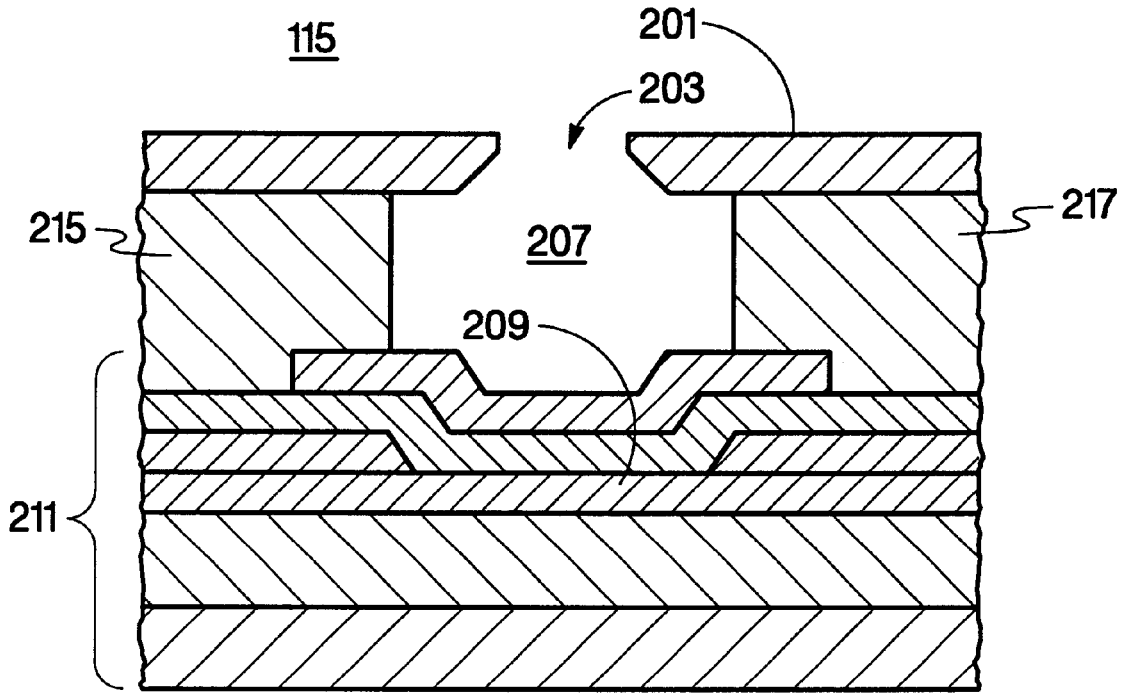
FIG. 2 is a cross section of the printhead showing a material stack which may comprise an ink ejecting apparatus of the printhead.

The printhead 115 of FIG. 1, which receives power from the power supply circuit 110 via power supply lines 140, is shown in a cross sectional view of FIG. 2. The printhead 115 is comprised of several individual layers of materials constructed and assembled to perform its function. An orifice plate 201 forms the outermost layer, the layer that is externally visible on the print cartridge and which is held in close proximity to the printing medium. A plurality of heater resistors 209 (more generally referred to as ink ejectors) is created by the selective plating of resistive and conductive materials on the surface of a silicon wafer. An ink barrier layer is selectively deposited upon the surface of substrate 211 so that inner walls 215, 217 of the ink firing chamber 207 are created.

In a preferred embodiment of the current invention, as the printhead is in close proximity to the printing medium 150, the printing medium moves transversely to the direction of the printhead at a particular rate. Correspondingly, the printhead is moved at a given rate across the medium (this movement referred to as the scan speed) proportionally to the frequency at which ink is ejected from the printhead. This frequency, herein referred to as the fluidic frequency ($f_f$), is characterized by the physical design of the orifice 203 and ink firing chamber 207 through which the ink is ejected upon the firing (or energizing) of a heater resistor 209. If a heater resistor is energized at a rate greater than the physical design of the orifice and firing chamber will allow, the images or text being printed will be distorted.

A group of heater resistors, herein referred to as primitives, are coupled through address lines to the electronic power supply circuit 110. Although the power supply circuit of FIG. 1 may be detached from the printhead, in a preferred embodiment, it is disposed in the substrate 211. Within a primitive, at least one heater resistor can be systematically or randomly fired. The number of heater resistors that define a primitive group is influenced by the required resolution of the printing system. Grouping heater resistors in this fashion to form primitives is illustrated in several patents. U.S. Pat. Nos. 5,635,968; 5,083,137 and 5,677,577 all disclose printing systems incorporating primitive groups of resistors. In a preferred embodiment, primitive groups consisting of 11 heater resistors are utilized.

Figure 3A:
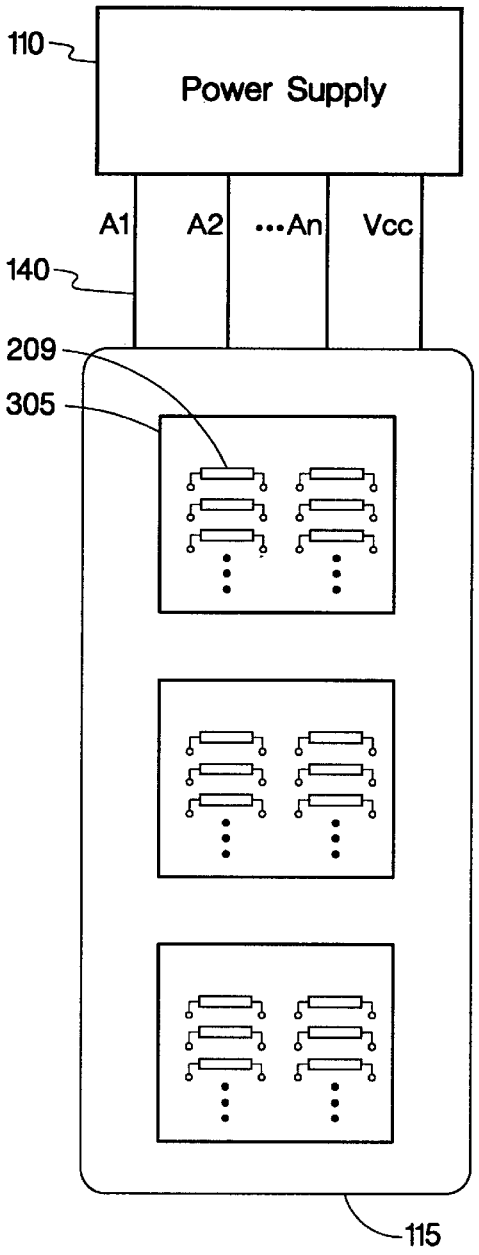
FIG. 3A illustrates a conventional printhead with schematic representation of primitives and heater resistors.
Figure 4A:
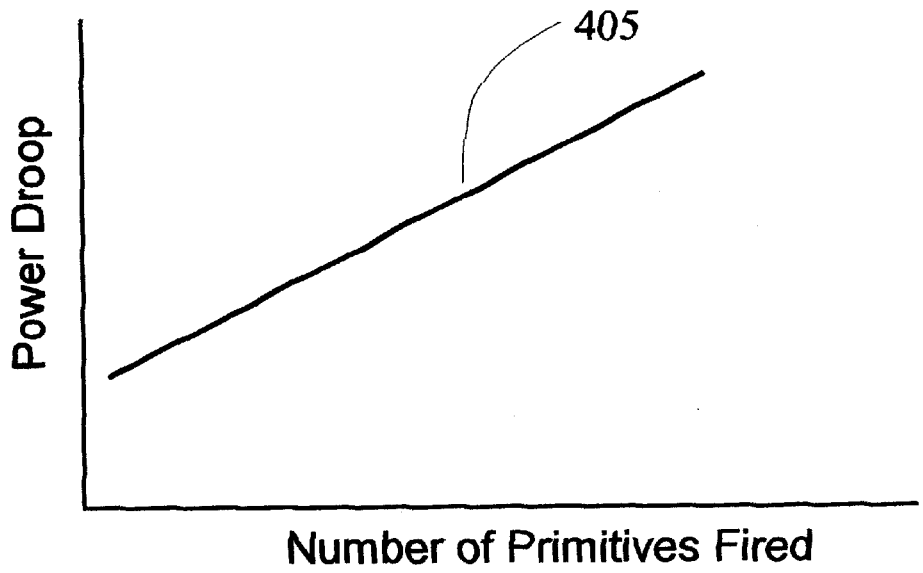
FIG. 4A is a plot of power droop versus fired primitives for a conventional printhead.

FIG. 3A is a diagrammatic representation of a typical printhead (A HP51645A is a representative of a type of printhead/print cartridge) consisting of several primitives 305. Located inside of each primitive group are several heater resistors 209 that are coupled to their associated address lines numbered $A_1$ to $A_n$. Where A represents the address and location of the heater resistor to be fired and n is an integer representing the number of addressable heater resistors within a primitive. The addressable heater resistors are fired with a series of electrical pulses that are generated by the power supply circuit 110 (commonly referred to as the drive circuit). Various designs and methods of manufacture exist for such circuits as described in U.S. Pat. Nos. 4,719,477; 4,532,530 and 4,947,192, however, a preferred embodiment of the current invention focuses on how power is distributed among the heater resistors within the primitives. In conventional designs when the printhead is required to print a solid color/black image (blackout mode) or vertical lines on the printing medium, a heater resistor in each primitive is simultaneously fired. Firing heater resistors simultaneously creates the worst loading condition on the power supply circuit thus exacerbating power droop as shown in FIG. 4A, reference line 405.

Figure 5:
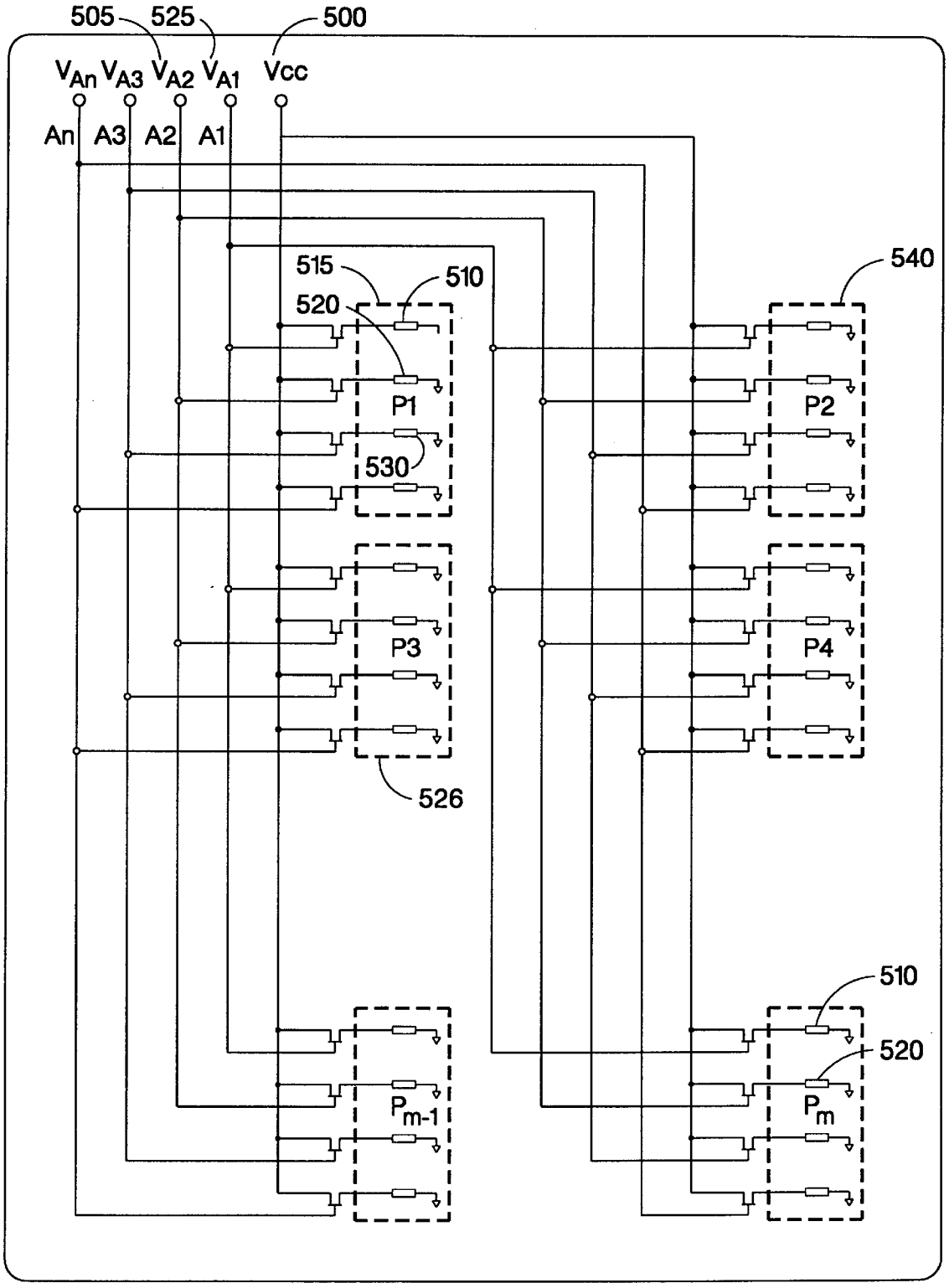
FIG. 5 is an illustration of how the addressable heater resistor in every primitive is simultaneously fired.

To apprehend how a conventional printhead is fired, consider FIG. 5. The firing sequence begins by turning on the printhead (applying a voltage at terminal Vcc 500). Next, a series of pulses are selectively applied to the printhead at terminals $V_{A1}$ to $V_{An}$. The pulses (FIG. 6) are generated by the power supply circuit 110 and operate at a frequency (fp) having a distinct on-time ($t_{on}$) and off-time ($t_{off}$). In a conventional printhead with 11 addresses and a scan resolution of 600 dpi (drops per inch) operating at a $f_f$ of 18 kHz, $t_{on}$ is typically 2 $\mu$s and $t_{off}$ is typically 3 $\mu$s. The pulses shown in FIG. 6 and their associated reference numbers are listed in Table 1 where the final pulse (Pulse n) corresponds to the number of addressable heater resistors within a primitive.

TABLE 1

| Reference Number | Pulse number |
|---|---|
| 600 | Pulse 1 |
| 605 | Pulse 2 |
| 610 | Pulse 3 |
| 620 | Pulse n |

The firing sequence (under worst power droop conditions) is shown below for a conventional printhead:

Pulse 1: $A_1P_1$, $A_1P_2$, $A_1P_3$ . . . $A_1P_m$

Pulse 2: $A_2P_1$, $A_2P_2$, $A_2P_3$ . . . $A_2P_m$

Pulse 3: $A_3P_1$, $A_3P_2$, $A_3P_3$ . . . $A_3P_m$

Figure 6:
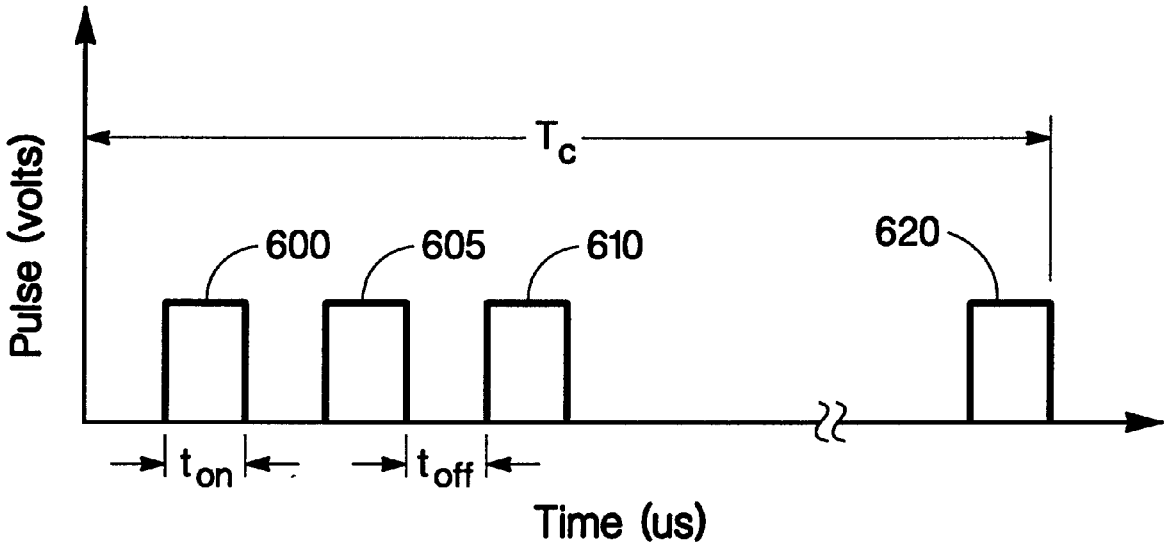
FIG. 6 is a pulse stream generated by the power supply circuit used to fire the heater resistors within the primitives.

When pulse 1 of FIG. 6 is applied to the printhead at terminal $V_{A1}$ 525 (FIG. 5), the first addressable heater resistor $A_1$ 510 in Primitive $P_1$ 515 is fired along with $A_1$ in primitive $P_2$ 540 along with $A_1$ in primitive $P_3$ 526 and ending with $A_1P_m$. Following a delay time equal to $t_{off}$, pulse 2 is applied to the printhead at terminal $V_{A2}$ 505 as illustrated in FIG. 5 and the second addressable heater resistor $A_2$ 520 in primitive $P_1$ 515 along with addressable heater resistor $A_2$ 520 in primitive $P_2$ 540 along with heater resistor $A_2$ 520 in primitive $P_3$ 526 and ending with $A_2P_m$. Similarly, pulse 3 is applied to terminal $V_{A3}$ and addressable heater resistor $A_3$ 530 in primitive P1 is fired along with addressable heater resistor $A_3P_2$, $A_3P_3$ . . . ending with $A_3P_m$. In a typical embodiment, the cycle time ($T_c$) of the system is therefore the time required to fire each heater resistor once in each primitive is shown below:

$$T_c=\Sigma_1^n(t_{on_n}+t_{off_n})$$

Upon completion of the cycle, a new cycle begins starting with $A_1P_1$. The time delay between the cycles is equal to $t_{off}$. As indicated in FIG. 4 line 405, for conventional designs, power droop is exacerbated because a resistor in each primitive is simultaneous fired. In the preferred embodiment of the present invention, however, power droop is significantly reduced by dividing the printhead into at least two substantially parallel columns as shown diagrammatically in FIG. 3B having an odd primitive column 310 and an even primitive column 315.

Figure 7:
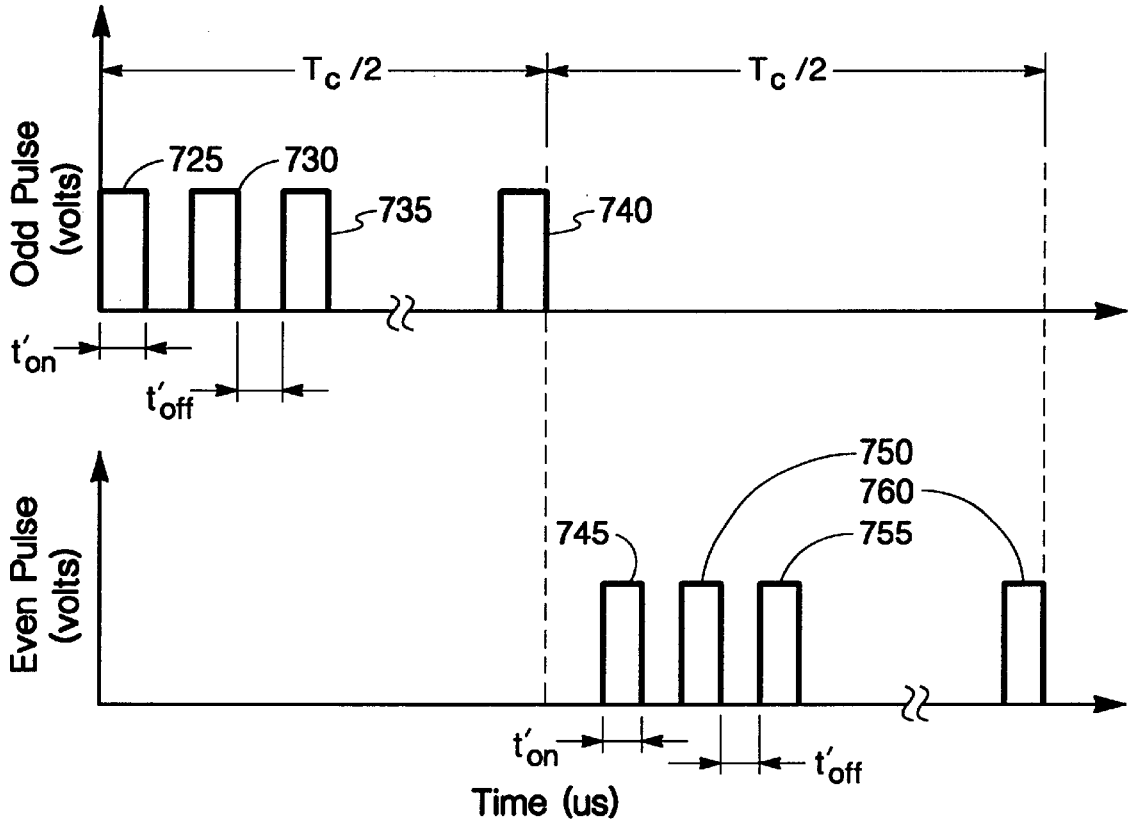
FIG. 7 is an odd and even pulse stream generated by the power supply circuit in a preferred embodiment.

FIG. 7 shows the series of pulses generated by the power supply circuitry in a preferred embodiment of the current invention. The pulses and figure reference numbers are illustrated in Table 2. The corresponding on-time, off-time and pulse frequency differ from conventional printer designs and are represented as $t'_{on}$, $t'_{off}$ and $f'_p$, respectively.

TABLE 2

| Reference No. Odd | Reference No. Even | Pulse number |
|---|---|---|
| 725 | 745 | Pulse 1 |
| 730 | 750 | Pulse 2 |
| 735 | 755 | Pulse 3 |
| 740 | 760 | Pulse n |

When the first pulse of the odd sequence as shown in FIG. 7 is applied to the odd primitive column 310 (FIG. 8), once the printhead is turned on by applying a voltage at terminal Vcc, the following addressable heater resistors are fired:

Pulse 1: $A_1P_1$, $A_1P_3$, $A_1P_5$ . . . $A_1P_{m-1}$

Pulse 2: $A_2P_1$, $A_2P_3$, $A_2P_5$ . . . $A_2P_{m-1}$

Pulse 3: $A_3P_1$, $A_3P_3$, $A_3P_5$ . . . $A_3P_{m-1}$

Figure 8:
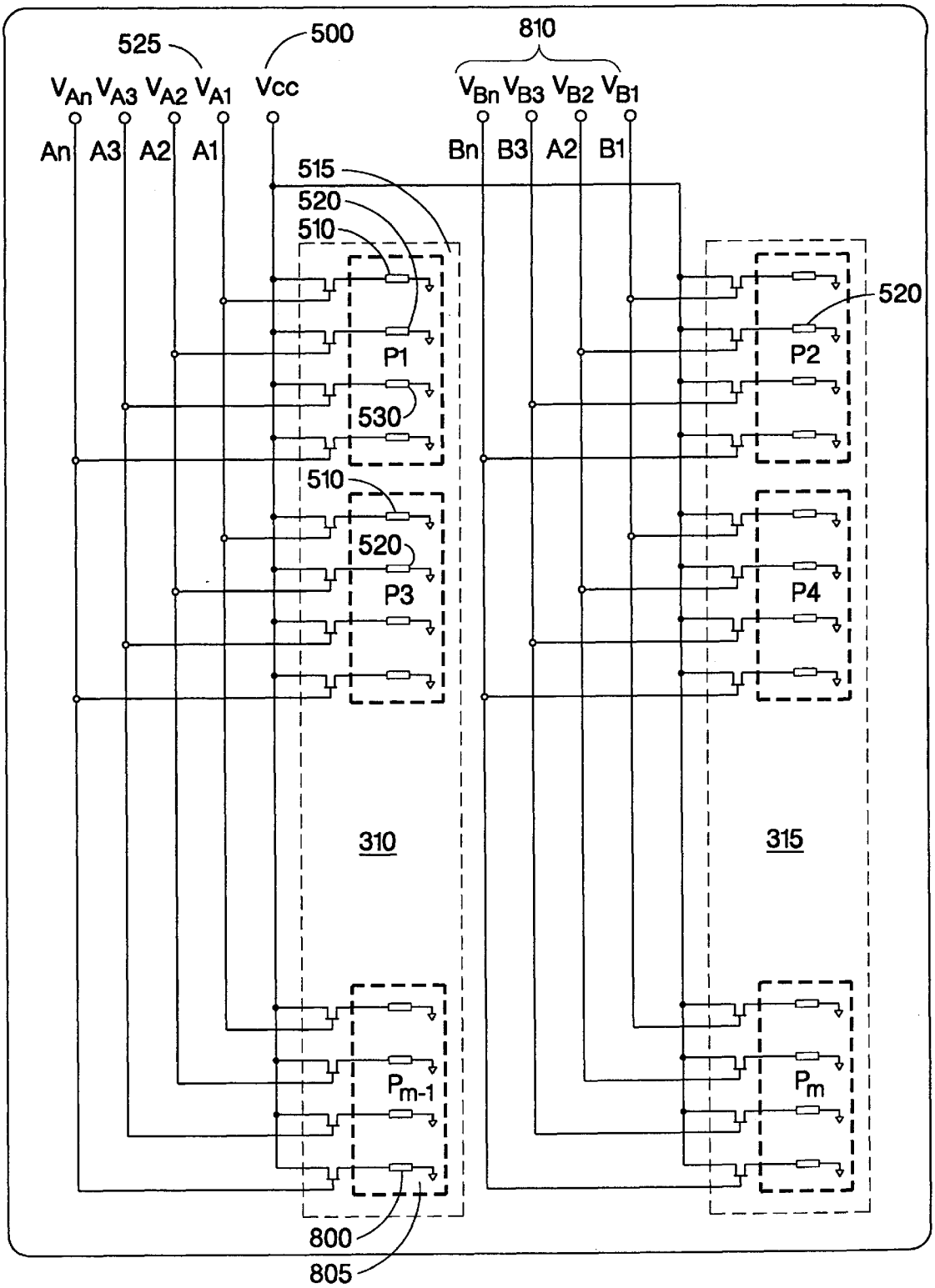
FIG. 8 is an illustration of a primitive firing technique for odd and even substantially parallel primitives in a preferred embodiment.

Here, the firing of the last addressable heater resistor $A_n$ 800 (caused by applying pulse n 760 to terminal $V_{An}$) in the last odd primitive $P_{m-1}$ 805 occurs in one half of the cycle time ($T_c/2$) as compared to the conventional design shown in FIG. 3A and FIG. 5. FIG. 8 illustrates how all of the odd primitives are made active (a heater resistor can be fired) while the even primitives are inactive ($V_{B1}$ to $V_{Bn}$ 810 is equal to zero). After a time equal to $t'_{off}$ following the firing of $A_nP_{m-1}$ 800, 805 the even primitives 315 are fired by the even pulse series (FIG. 7) accordingly as shown in FIG. 8:

Pulse 1: $B_1P_2$, $B_1P_4$, $B_1P_6$ . . . $B_1P_m$

Pulse 2: $B_2P_2$, $B_2P_4$, $B_2P_6$ . . . $B_2P_m$

Pulse 3: $B_3P_2$, $B_3P_4$, $B_3P_6$ . . . $B_3P_m$

The cycle time associated with a preferred embodiment of the current invention is shown below:

$$T'_c=\Sigma_1^n(t'_{on_n}+t'_{off_n})$$

By firing one half of the primitives in one half of the period ($T_c$) the power demand placed on the drive circuitry is significantly reduced. Consequently, the power droop is minimized. In a preferred embodiment $T_c$ is equal to $T_c'$ which implies that all of the heater resistors in the odd primitives are systematically fired (while the even primitives are inactive) followed by the systematic firing of all the heater resistors in the even primitives (while the odd primitives are inactive).

Figure 3B:
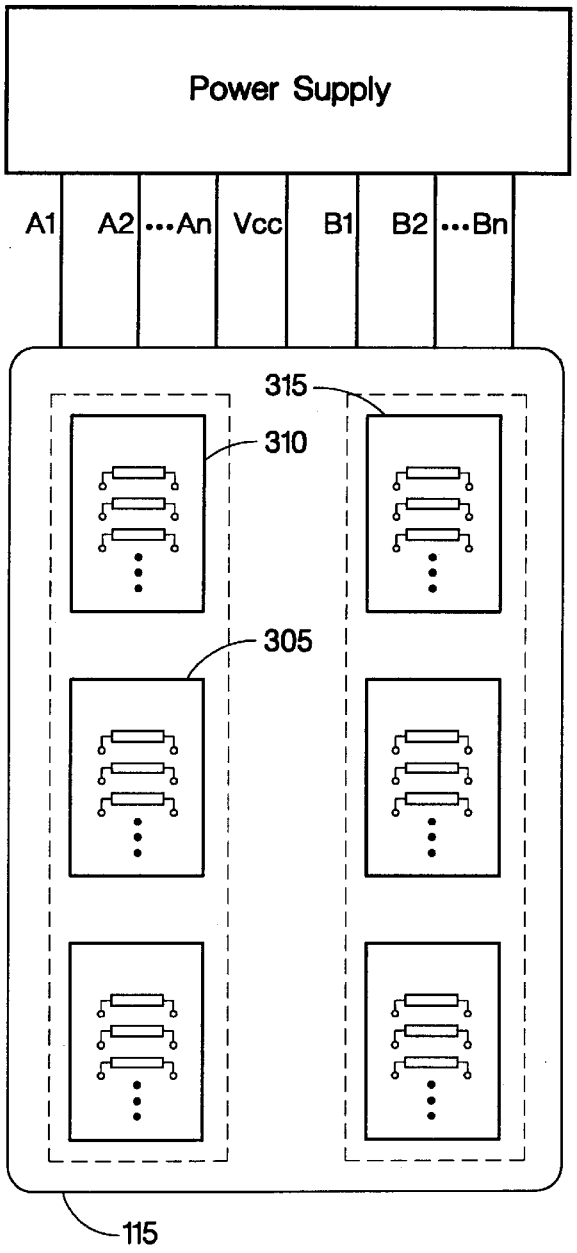
FIG. 3B illustrates a preferred embodiment of the current invention with parallel columns of primitives.
Figure 4B:
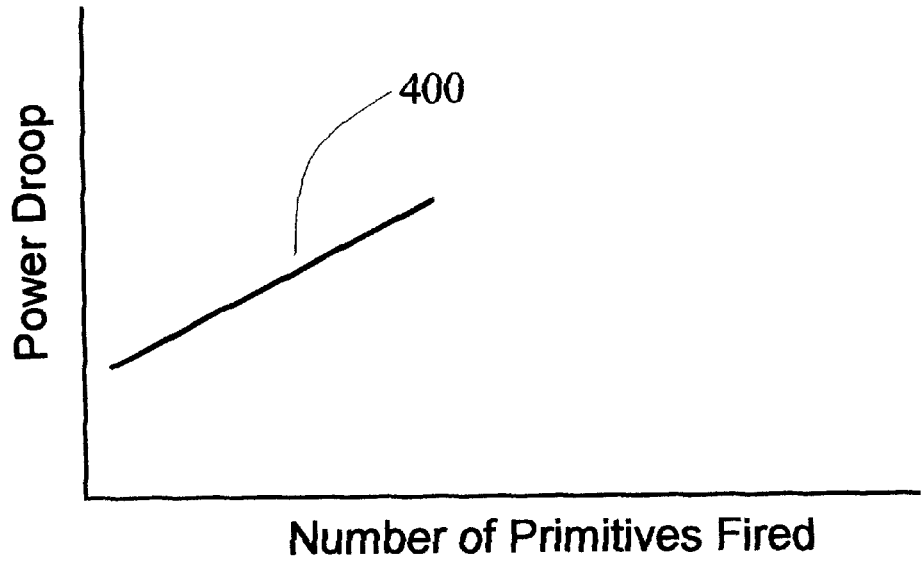
FIG. 4B is a plot of power droop versus fired primitives for a preferred embodiment of the current invention.

In a preferred embodiment, firing one half of the primitives in one half of the period followed by the second half significantly reduces power droop as illustrated in reference line 400 in FIG. 4B because a reduced number of primitives are fired at a time. The aforementioned firing technique in a preferred embodiment requires (as compared to conventional designs) a power supply circuit that generates pulses at a higher frequency. The pulse frequency ($f_p$) must be greater than a predetermined fluidic frequency ($f_f$) of the printhead in order to fire both odd and even primitives within the same period ($T_c$) as the conventional printhead. It is possible to reduce power droop further by designing the power supply circuit to deliver pulses at frequencies greater than the predetermined fluidic frequency as shown below:

$$f_p>n(DPI)S_c=nf_f$$

Where n is an integer greater than one, DPI is the scan resolution (dots per inch of ejected ink), $S_c$ is the speed at which the printhead is moved across the printing medium. In a typical 600 dpi (dots/inch) printhead, where $S_c$ is 30 inches/second, $f_f$ is 18 kHz. Additionally, the primitive columns in FIG. 3*b* and FIG. 8 are separated by a predetermined distance. This distance in conjunction with the scan speed and frequency at which the pulses are turned on and off ($t_{on}$ and $t_{off}$) is related to the DPI of the printing system. A typical separation distance of the columns is 2.84 millimeters with a scan speed of 30 inches/sec at 600 DPI.

In the aforementioned illustration of a preferred embodiment, the resistors were fired assuming a black out print mode (all resistors were systematically fired) however, most printing applications require a smaller percentage of the resistors to be fired. Consequently, FIG. 7 will not consist of a continuous series of pulses, instead, the generation of a pulse may be infrequent corresponding to the printing instruction supplied by the printer to the printhead. Once the printing instructions have been received by the printhead, the proper address line (corresponding to the location an ink droplet will be placed on the writing medium) is enabled along with Vcc (FIG. 8). In a preferred embodiment of the current invention, Vcc remains enabled for all primitives in both columns, however, a particular heater resistor is made active only when an address line is enabled.

Figure 3C:
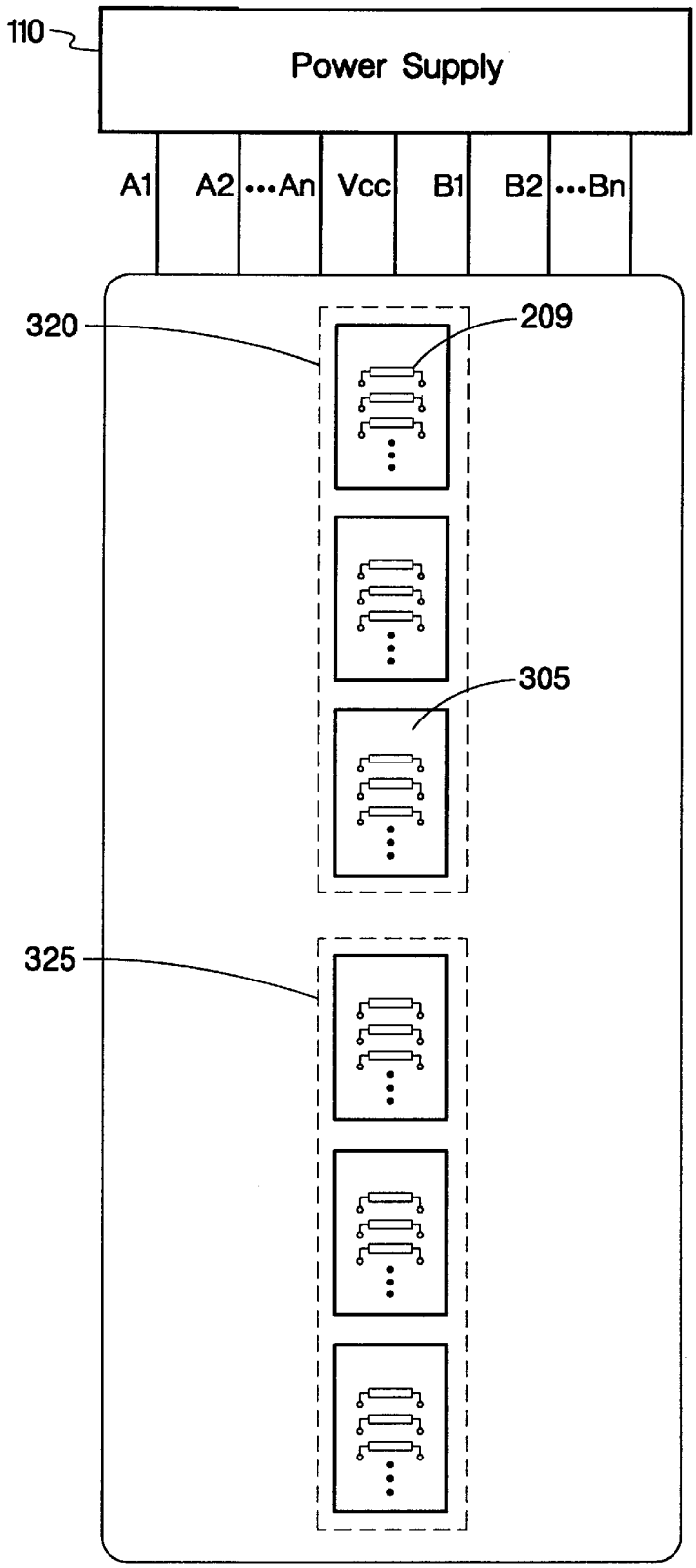
FIG. 3C illustrates a preferred embodiment of the current invention with vertically stacked columns of primitives.

Although in a preferred embodiment of the current invention the primitives are divided into two substantially parallel columns and the odd column is fired first, more generally, any one column may be fired followed by the next column. Additionally, groups of primitives may be fired in arrangements other than columns. For example, the printhead may be partitioned into selected groups or quadrants such that all heater resistors in each group or quadrant can be sequentially fired within the same cycle time as the conventional printhead. FIG. 3C illustrates such an embodiment wherein the upper primitive groups 320 and the lower primitive groups 325 are sequentially and selectively fired. Moreover, the heater resistors within a primitive may be fired starting with any heater resistor within the primitive and ending with the last heater resistor within the primitive.

We claim:

1. A method for ejecting ink onto a writing medium from an inkjet printer with a predetermined scan resolution comprising the steps of:

moving said printhead nozzle relative to a writing medium at a scan speed;

expelling ink of a mass to cover an area of the writing medium from a printhead nozzle at a fluidic rate, said fluidic rate being equal to the product of a scan resolution and said scan speed; and generating energizing pulses at a frequency greater than an integer greater than one time said fluidic rate.

2. The method in accordance with the method of claim 1 further comprising the step of:

generating energizing pulses at a predetermined rate and, selectively and sequentially applying said energizing pulses to said ink ejectors.

3. The method in accordance with the method of claim 1 further comprising the step of moving said print cartridge transversely to a direction of print medium being feed into said inkjet printer.

4. An inkjet printing system comprising:

a computer; and an ink jet printer including a print cartridge capable of being moved relative to a print medium at a scan speed traverse to the direction of print medium feed, said print cartridge including, a power supply circuit having an energizing rate, and a printhead comprising at least two primitive groups of ink ejectors, including a first primitive group of said at least two primitive groups being arranged in a first column, and a second primitive group of said at least two primitive groups being arranged in a second column, wherein adjacent ink ejectors of said majority of said ink ejectors within each of said first and second primitive groups are spaced apart by a predetermined distance defining a scan resolution, each ink ejector in said first primitive group being energized selectively by instruction of said computer and sequentially energized by said power supply circuit followed by each ink ejector in said second primitive group being energized selectively by instruction of said computer and sequentially energized by said power supply wherein the sum of a time to energize all ink ejectors of said first and second primitive groups equals a cycle time, wherein a duration of time required to selectively and sequentially energize all said ink ejectors of said first and second primitive groups is the reciprocal of the product of the scan speed and the scan resolution, and wherein the product of said scan speed, said scan resolution and an integer greater than one is less than the energizing rate of said power supply circuit.

5. The inkjet printing system of claim 4 wherein said energizing rate of said power supply circuit is equal to the reciprocal of said cycle time.

* * * * *